US005199900A

United States Patent [19]

Hayes, Sr.

[11] Patent Number: 5,199,900

[45] Date of Patent: Apr. 6, 1993

[54] PANEL MOUNT ELECTRICAL CONNECTOR

[75] Inventor: Earl J. Hayes, Sr., Mechanicsburg, Pa.

[73] Assignee: AMP Incorporated, Harrisburg, Pa.

[21] Appl. No.: 839,855

[22] Filed: Feb. 21, 1992

[51] Int. Cl.[5] ..... H01R 13/74

[52] U.S. Cl. ..... 439/557; 439/247

[58] Field of Search ..... 439/557, 247, 552, 554, 439/562, 544

[56] References Cited

U.S. PATENT DOCUMENTS

| | | | |
|---|---|---|---|
| Re. 32,760 | 2/1987 | Chandler et al. | 439/188 |
| 2,891,103 | 4/1957 | Swengel | 174/153 |
| 3,217,319 | 11/1965 | Rueger | 439/557 |
| 3,523,269 | 8/1970 | Witek, Jr. et al. | 439/557 |
| 3,820,053 | 6/1974 | Champion et al. | 439/544 |
| 4,168,874 | 9/1979 | Weidler et al. | 439/557 |
| 4,261,633 | 8/1979 | Abernethy | 439/405 |
| 4,947,010 | 8/1990 | Heydner et al. | 439/557 |
| 4,995,831 | 2/1991 | Casagrande | 439/557 |

*Primary Examiner*—Gary F. Paumen

*Attorney, Agent, or Firm*—Bruce J. Wolstoncroft

[57] ABSTRACT

An electrical connector assembly has a frame member which is positioned on a housing and is movable between an terminal insertion position and a terminal lock position. The frame member has resilient fingers with extend into terminal receiving cavities of the housing to properly position and maintain the terminals in the terminal receiving cavities when the frame member is in the terminal lock position. The frame member has anti-rattle projections which cooperate with a panel when the assembly is mounted therein. The anti-rattle projections ensure that a positive electrical connection will be effected and maintained over time.

8 Claims, 8 Drawing Sheets

PANEL MOUNT ELECTRICAL CONNECTOR

FIELD OF THE INVENTION

The invention is directed to an electrical connector for mounting to a panel. In particular, the invention relates to an electrical connector assembly which has projections extending therefrom which cooperate with the panel to maintain the assembly in position.

BACKGROUND OF THE INVENTION

There are many instances in which electrical connectors are used in relatively harsh environments, such as where vibration and the like cause the connector to be damaged or ineffective. In a passenger compartment of an automobile, electrical connectors must be secured in position on panels, otherwise the vibration can cause the electrical connection between mating terminals to become ineffective over time. This is an unacceptable result.

The vibration can also cause the electrical connectors to be dislodged from the panel. In order to prevent the movement of the electrical connectors relative to the panels, complicated and redundant latches were used, thereby adding to the cost of the connector.

Consequently, it would be beneficial to provide an electrical connector with means to prevent the vibration of the connector relative to the panel in which it is mounted, thereby reducing the complexity of the connector and enhancing the ability of the connector to provide a stable and reliable electrical connection over a long period of time.

SUMMARY OF THE INVENTION

The invention is directed to an electrical connector which is inserted into a an opening of a panel. The electrical connector has a housing with terminals positioned in terminal receiving cavities of the housing. Resilient projections extend from the housing and cooperate with sidewalls of the opening. The resilient projections have first ends which are essentially coplanar with respective surfaces of the housing and second ends which are spaced from the first ends. Portions of the second ends are spaced from the plane of the respective surfaces of housing. The resilient projections are inclined from the first ends to the portions of the second ends, whereby as the electrical connector is inserted into the opening of the panel, the second ends of the resilient projections will be elastically deformed by sidewalls of the opening, thereby causing the second ends of the resilient projections to exert a force on the sidewalls of the opening. This cooperation of the resilient projections of the housing with the sidewalls of the openings ensures that the electrical connector will be properly positioned and adequately maintained in the opening of the panel.

DETAILED DESCRIPTION OF THE INVENTION

Figure 1:
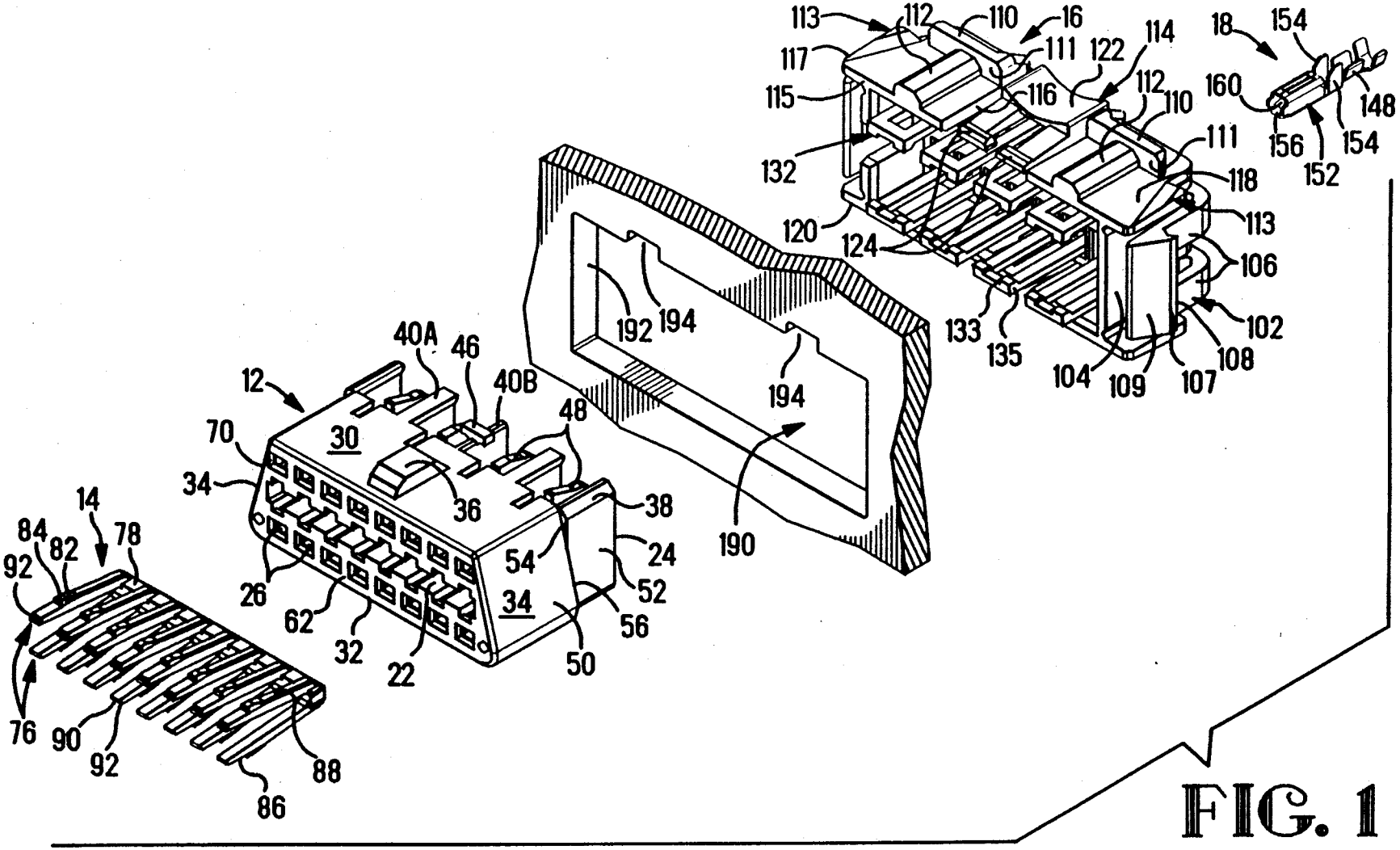
FIG. 1 is an exploded view of a header assembly constructed in accordance with the invention.

With reference to FIG. 1, header assembly 10 includes a housing 12, terminal latch 14, dielectric frame member or terminal position assurance (TPA) member 16 and terminals 18. The terminal latch 14 is inserted into slot 22 of the housing 12. The TPA member 16 is then assembled to a rear face 24 of the housing, positioning the member 16 in a first position. Terminals 18 are inserted through the TPA member 16 into terminal receiving cavities 26 in the housing 12, and are retained in position by latch 14. Thereafter, TPA member 16 is pushed and locked into a final position to form assembly 10.

Referring in detail to the various components, housing 12 may be molded from a suitable plastics material such as PBT. Its exterior configuration includes parallel top and bottom surfaces 30, 32 and complex side surfaces 34. With respect to top surface 30, an orientation latch block 36 is located centrally thereon. Rear portion 38 is slotted in registration with cavities 26 to define dividing walls 40. Walls 40A are non-resilient and have surfaces which are coplanar with the top surface 30. A particular wall 40B has a latch post 46 provided thereon which extends beyond the top surface 30. Rear portion (not shown) of bottom surface 32 also includes walls, one of which has a latch post, which are essentially identical to that described above.

A plurality of terminal receiving cavities 26 are provided in housing 12. As best shown in FIG. 1, each cavity 26 has a dividing wall 40 defining one side thereof, and a camming wall 48 defining the opposing side. Unlike the dividing walls 40, the camming walls 48 do not extend to the top or bottom surface 30, 32 of the housing 12.

The camming walls 48 have an inclined surface 47 and a locking shoulder 49 adjacent the inclined surface, as is best shown in FIGS. 3 through 7. The inclined surface and locking shoulder cooperate with the TPA member 16, as will be more fully discussed.

Referring again to FIG. 1, side surfaces 34 include front portions 50 which slant inwardly to surface 30 from surface 32 and parallel rear portions 52. The juncture of portions 50, 52 provide forwardly facing shoulders 54 near surface 30 and rearwardly facing shoulders 56 near opposite surface 32.

The slot 22 enters housing 12 through front face 62, as do openings 70. The walls defining slot 22 are provided with orifices (not shown) which are in alignment and communicate with respective cavities 26. Openings 70 lead to cavities 26 through face 62.

Terminal latch 14 may also be molded from PBT. Latch 14 includes two rows of spring arms 76 extending outwardly from support 78. Each row of arms 76 are positioned to enter respective orifices in slot 22 and enter respective terminal cavities 26. Each arm 76 has a thicker portion 82 which is stepped down to provide a boss 84 and forwardly facing shoulder 86, both being on outside edge 88. Shoulders 86 are adjacent to free ends 90 to define notches 92.

Figure 2:
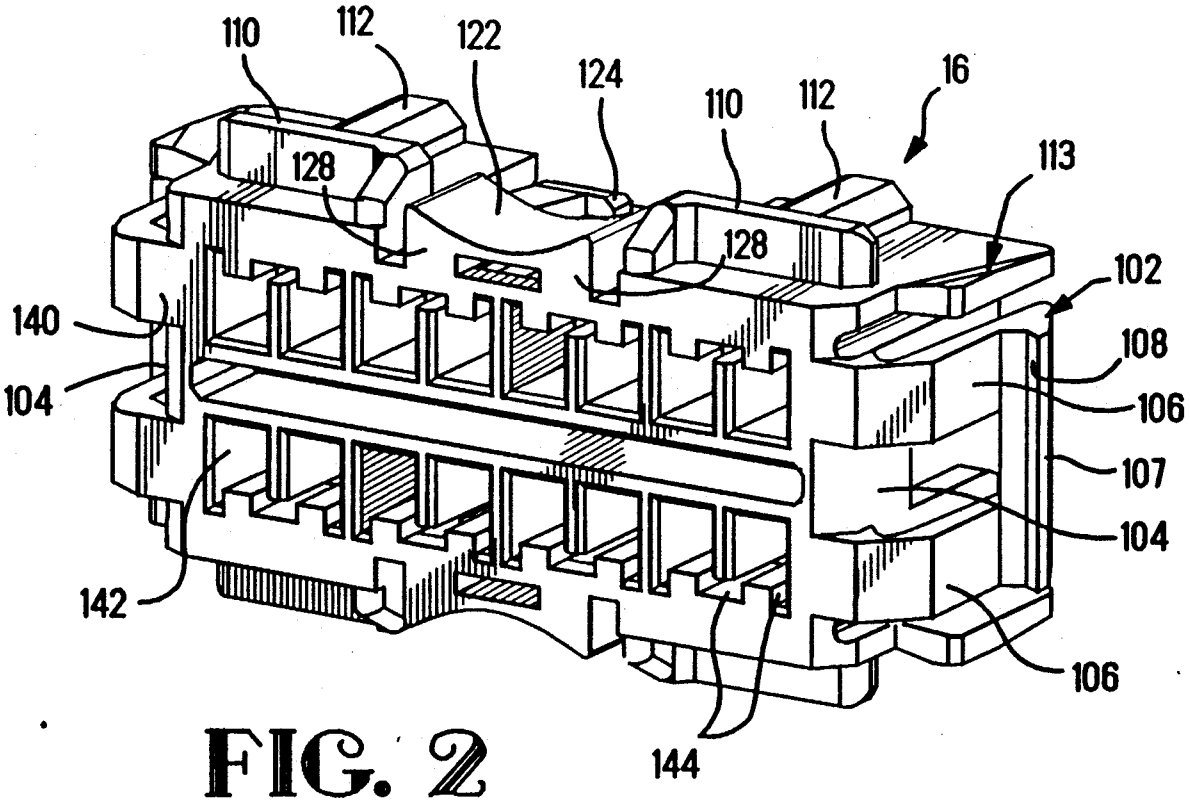
FIG. 2 shows a reverse face of a terminal position assurance member of the assembly.

TPA member 16, as shown in FIGS. 1 and 2, includes panel locks 102 on side surfaces 104. Each lock 102 has two spaced-apart, forwardly projecting spring arms 106. Securing members 107 extend across the spring arms 106 proximate the ends thereof. The securing members 107 are integrally attached to the spring arms such that the securing members and spring arms act as single members. Each securing member 107 has a rearwardly facing shoulder 108 and a forwardly facing lead-in surface 109.

Stop projections 110 extend from top and bottom surfaces 118, 120 of member 16. Each stop projection 110 has a forwardly facing surface 111. Polarizing projections 112 are provided proximate respective stop projections 110.

Figure 8:
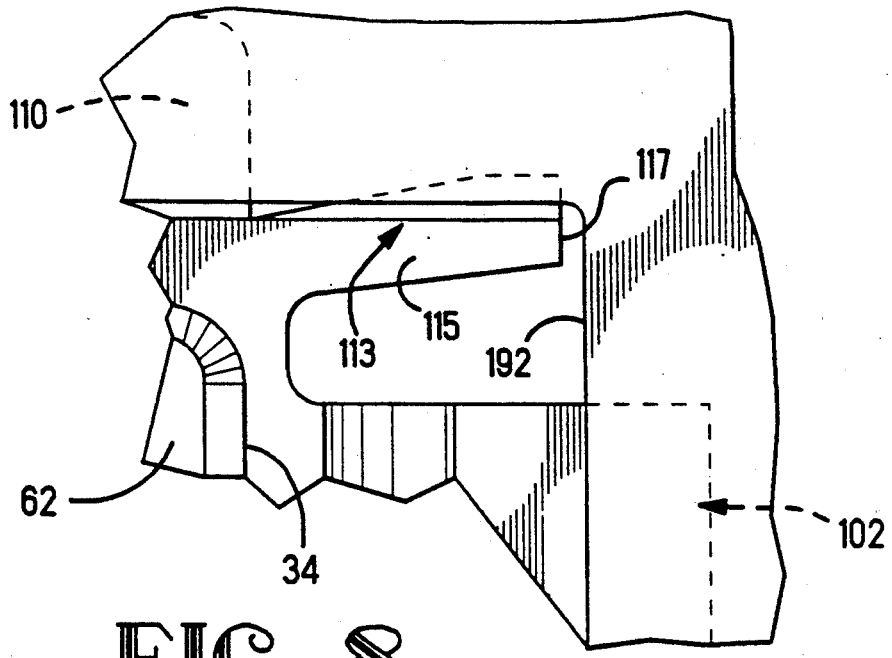
FIG. 8 is an enlarged view of a anti-rattle projection of the terminal position assurance member in a preinsertion position.
Figure 9:
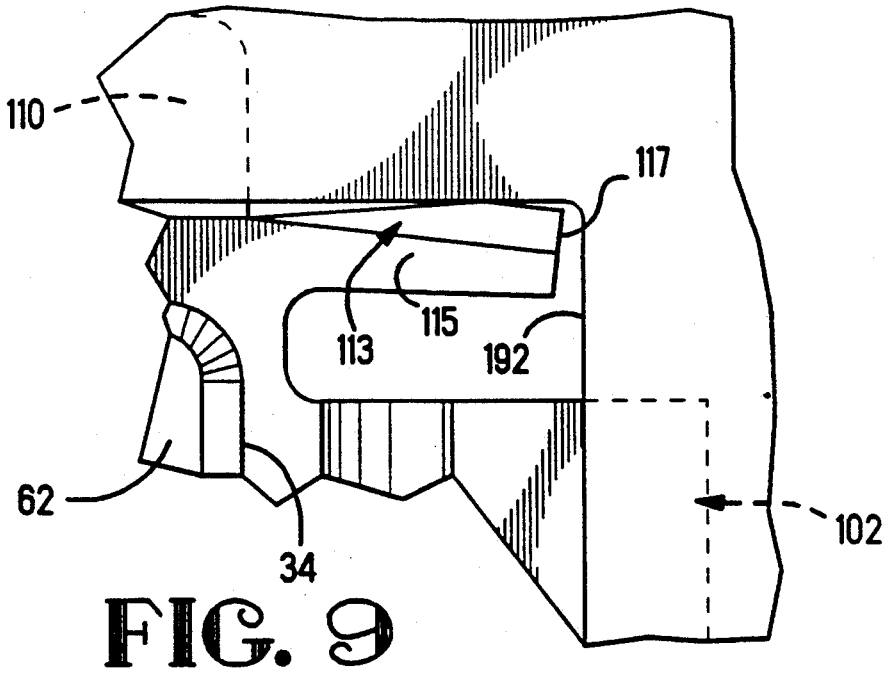
FIG. 9 is an enlarged view, similar to that of FIG. 8, showing the anti-rattle projection in an inserted position in a panel.

Anti-rattle projections 113 extend from top and bottom surface 118, 120 beyond side surfaces 104. The anti-rattle projections 113 are integrally molded with the top and bottom surfaces. Fixed ends 115, as best shown in FIGS. 8 and 9, of projections 113 extend in a direction which is generally coplanar to the top and bottom surfaces. The anti-rattle projections have a slightly inclined (sloped, arcuate, etc.) configuration, such that the free ends 117 of the projections 113 are positioned in planes which are outside the planes of the respective top and bottom surfaces. The anti-rattle projections are inclined more proximate the stop projections 110, i.e. a slight inclined configuration of the projections is also provided from the front of the projections 113 to the back, thereby providing a type of compound inclined surface which provides a lead-in surface, as will be more fully discussed.

Pivoting latches 114, as shown in FIGS. 1 and 2, are provided in recesses 116 on surfaces 118, 120 and include squeeze bars 122 and latch bars 124. The pivot points on latches 114 are indicated by reference numeral 128.

Two rows of resilient fingers 132 extend outwardly through front opening from within cavity 136 of TPA member 16. Fingers 132 are on the same pattern as are terminal receiving cavities 26 and are in registration therewith. As is best shown in FIG. 1, a web 133 extends between respective adjacent resilient fingers 132. Web 133 is integrally attached to free ends of the respective adjacent resilient fingers. The free ends of the resilient fingers 132 have enlarged projections 135 which extend therefrom.

Rear face 140 of member 16, shown in FIG. 2, is provided with openings 142 into cavity 136. Each opening 142 includes polarizing slots 144 at respective corners thereof.

Terminals 18 (preferably stamped and formed from tempered brass and tin plated), shown in FIG. 1, include rectangular receptacles 152, and ferrules 148 which are crimped around wires 150. At the rear ends of receptacles 152 are polarizing stubs 154 which project outwardly. Biasing first spring arms 156, attached to floors of receptacles 152, are folded to project into the receptacles through openings 160. The particular configuration of the receptacle 152 can be varied according to need. Many configurations are known in the art, and any one may be used for particular applications.

Figure 3:
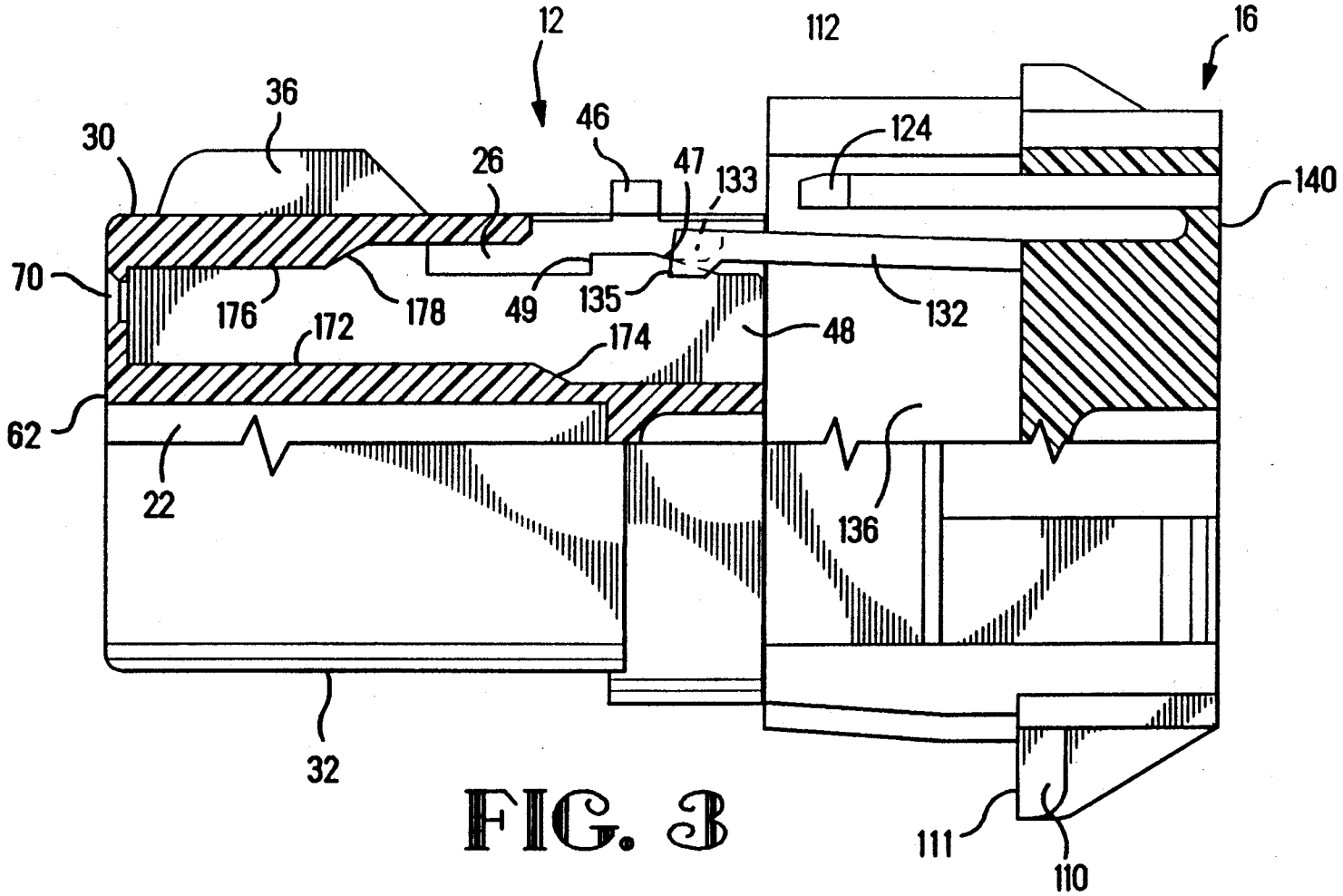
FIG. 3 is a side view of the terminal position assurance member as it is inserted onto a housing of the assembly, portions of the member and housing have been cut away for clarity.
Figure 4:
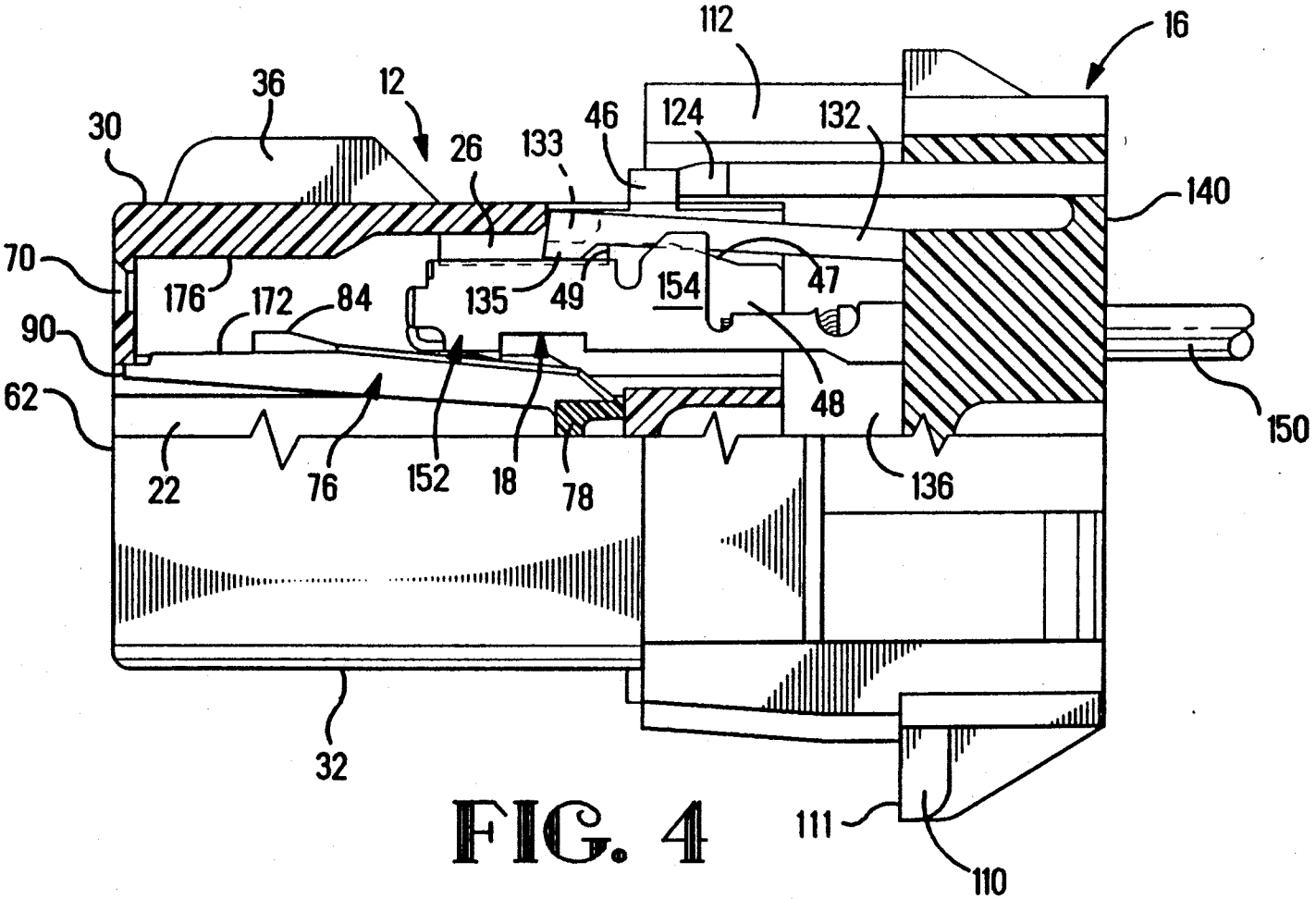
FIG. 4 is a side view similar to that of FIG. 3, showing the terminal position assurance member positioned in the initial position, and a terminal partially inserted into a terminal receiving cavity of the housing.

Reference in now made to FIGS. 3 and 4 which show the interior of housing 12. Cavities 26 are open at rear face 24. Surface 172 of cavities 26 include ramp 174 to decrease the thickness of the front portion. Opposite surface 176 also include a ramp 178. The openings 70 through front face 62 are beveled inwardly to guide tab terminals (not shown). An advantage of this configuration is that cavities 26 are inwardly from front face 62 so that the terminals are fully protected.

Terminal latch 14 is inserted into slot 22 in housing 12 and maintained in position. A more detailed explanation of the terminal latch is provided in copending U.S. patent application Ser. No. 07/737,003 filed Jul. 29, 1991, which is hereby incorporated by reference.

After the terminal latch 14 has been positioned in housing 12, TPA member 16 is moved into engagement with the housing and the terminals 18 are inserted into the terminal receiving cavities 26. This process is shown in FIGS. 3 through 7.

Referring to FIG. 3, TPA member 16 is moved into engagement with housing 12. As this occurs, webs 33, which extend between resilient fingers 132, engage the inclined surface 47 of camming walls 48. As the TPA member 16 is moved toward housing 12, the webs 133 will slide on the inclined surfaces 47 causing the webs to move toward the top surface 30 of the housing. As the web is integrally attached to the resilient fingers, the movement of the web causes the resilient fingers to move to a stressed position. This is continued until the webs 133 are moved beyond the inclined surfaces. As the webs are moved beyond the inclined surfaces, the resilient arms are allowed to return to their unstressed position, which in turn causes the web to move away from the top surface of the housing. In this position, the webs 133 cooperate with the locking shoulders 49 of the camming walls 48 to prevent the removal of the TPA member 16 from the housing 12. This defines an initial or terminal insertion position. It is worth noting, that every web cooperates with a locking shoulder when the terminal insertion position is reached. This feature ensures that each resilient finger is properly positioned in its respective cavity. Consequently, even if an elongate connector is required, the resilient fingers will be properly positioned.

With the TPA member 16 secured in the initial or terminal insertion position, the terminals 18 are inserted through the rear surface 140 into cavities 136 of member 16. As the insertion of the terminals continues, the terminals are advanced from cavities 136 into terminal receiving cavities 26 of housing 12.

Referring to FIG. 4, the insertion of the terminals 18 into the terminal receiving cavities 26 causes the terminals to engage a lead-in surface of the enlarged projections 135 of the resilient fingers 132. As the receptacles 152 of the terminals have a larger height than the distance provided between the enlarged projections 135 and the surface 172, the insertion of the terminals causes the receptacles to move the enlarged projections toward the top surface 30 of the housing. This causes the resilient fingers to move accordingly, thereby forcing the resilient fingers to a stressed position.

The enlarged projections 135 are dimensioned such that as the terminals are inserted into the cavities, the enlarged projections 135 will maintain the resilient fingers in a stressed position. In this stressed position, the TPA member 16 can not be moved to the final position, as the enlarged projections will engage the walls of the cavities.

Figure 5:
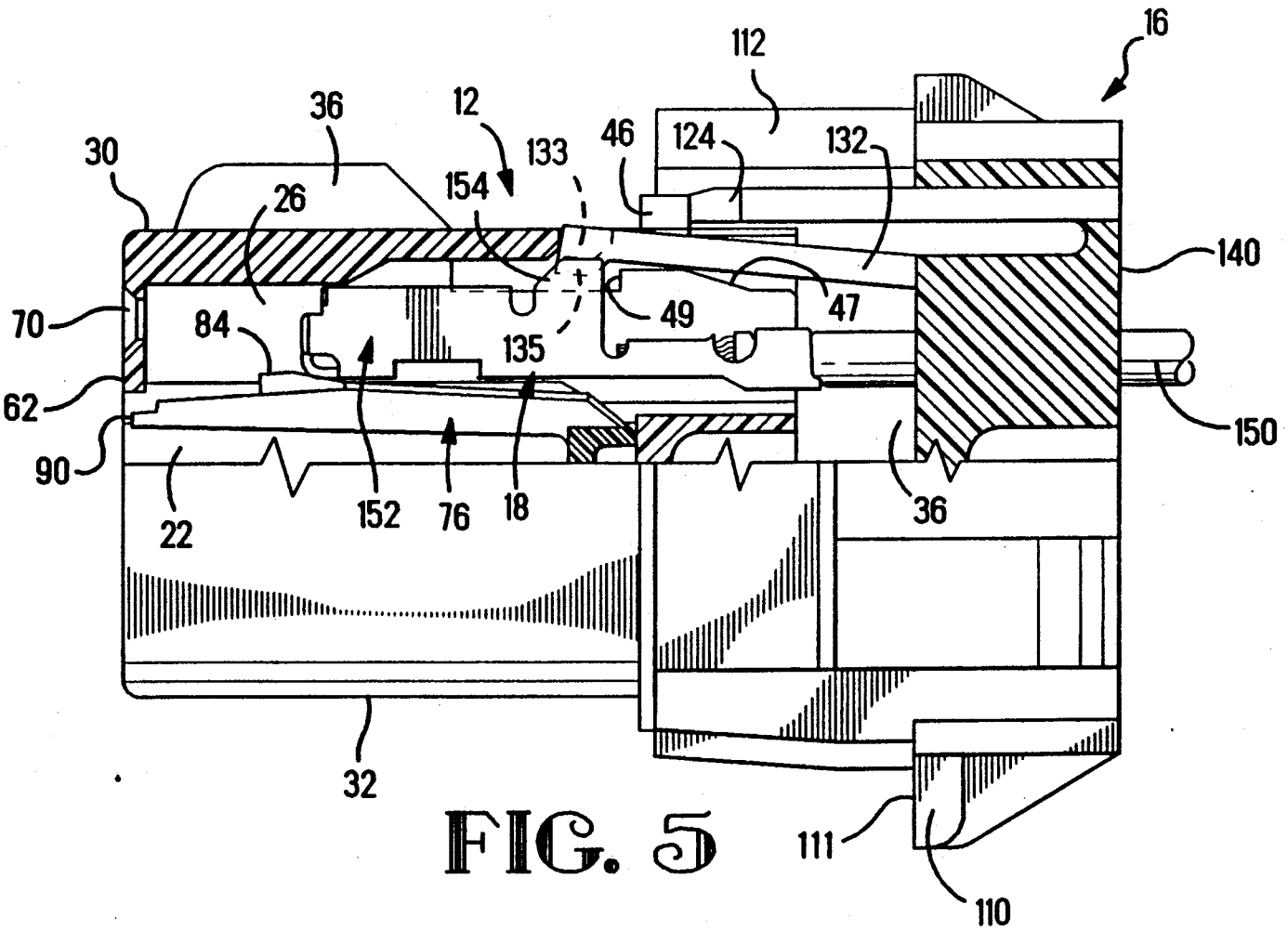
FIG. 5 is a side view similar to that of FIG. 4, showing the terminal further inserted into the terminal receiving cavity.

As the insertion of the terminals continues, respective polarizing stubs 154 engage the webs 133. As is shown in FIG. 5, this engagement forces the webs move further toward the top surface 30 of the housing 12, which in turn causes the resilient fingers 132 to be further stressed. It should be noted that the polarizing stubs 154 are spaced such that the polarizing stubs will not engage the enlarged projections 135 of the resilient fingers as the terminals are inserted into the cavities.

Figure 6:
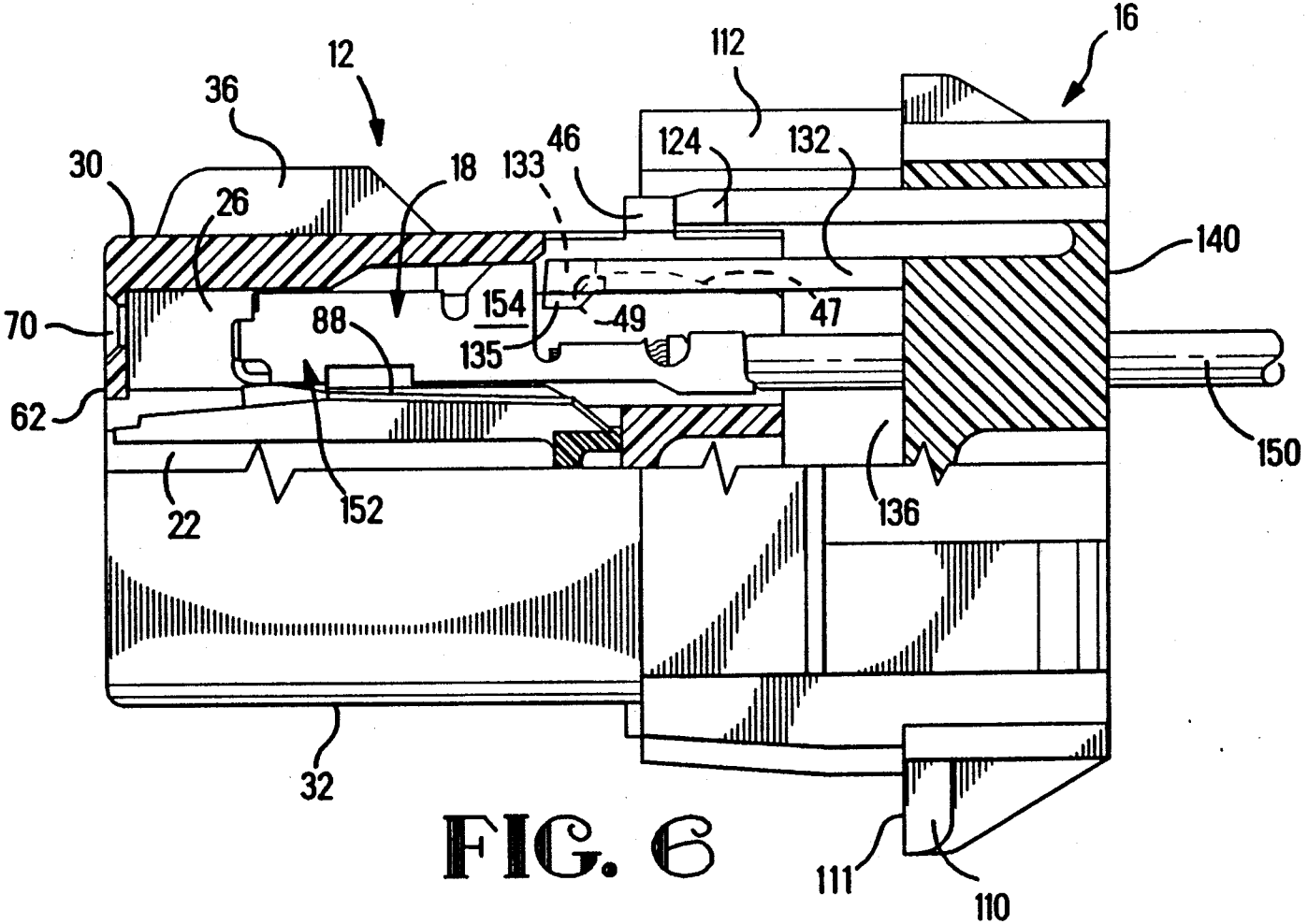
FIG. 6 is a side view similar to that of FIG. 5, showing the terminal inserted beyond a resilient finger of the terminal position assurance member.

The insertion of the terminals 18 continues such that the polarizing stubs 154 are moved beyond the webs 133, thereby allowing the resilient fingers 132 to return to an unstressed position, as shown in FIG. 6. In this position, the webs 133 are positioned to cooperate with the polarizing stubs 154 to prevent the withdrawal of the terminals from the terminal receiving cavities.

The insertion of the terminals is complete when the front of the receptacles are positioned adjacent to openings 70. As many variables are present during the insertion of the terminals into the terminal receiving cavities, not all of the terminals are properly positioned in the terminal receiving cavities after the above described insertion process is complete. It is therefore important that the a means be provided to ensure that the terminals are properly seated in the cavities.

Figure 7:
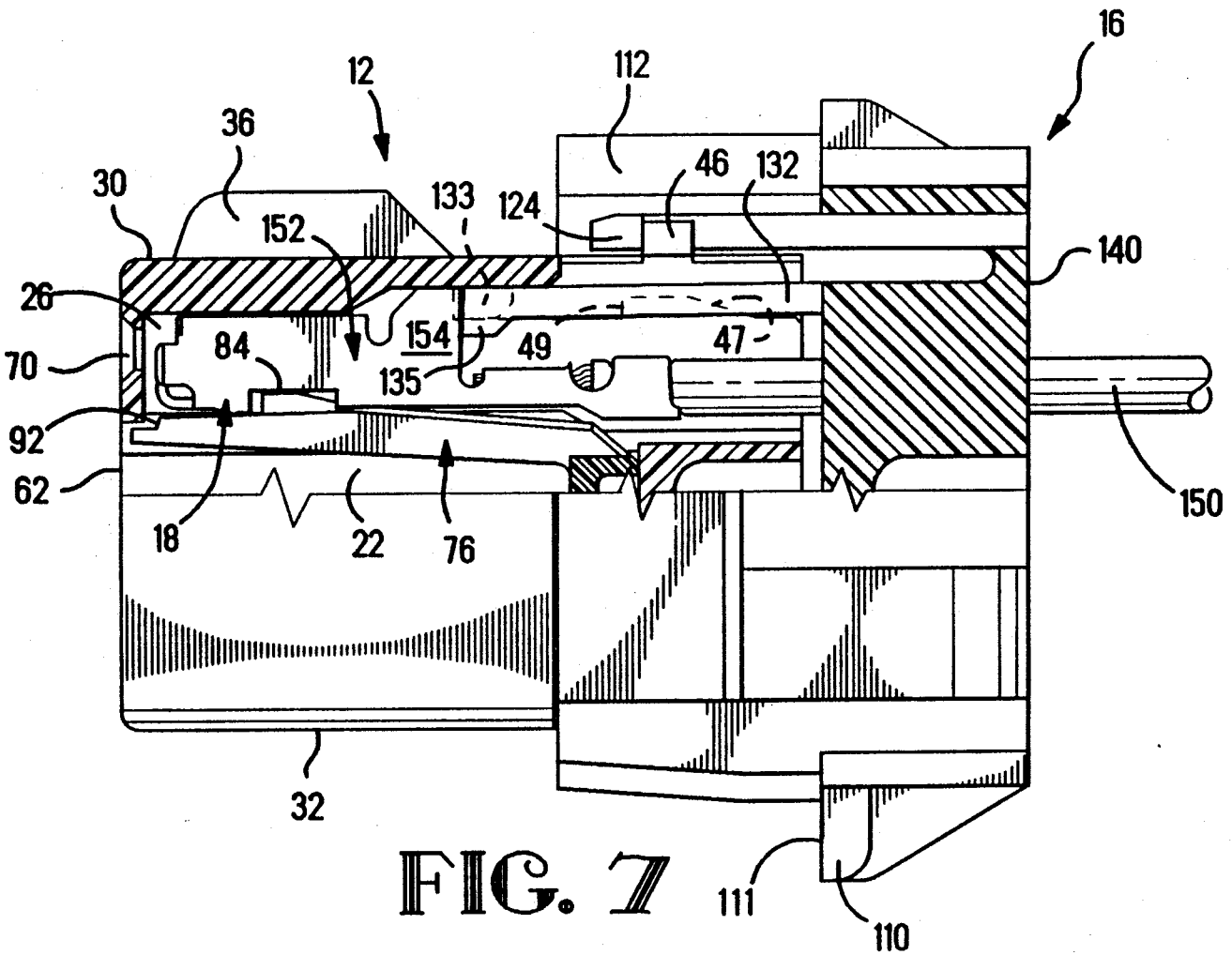
FIG. 7 is a side view similar to that of FIG. 6, showing the terminal fully inserted and the terminal position assurance member moved to a final position.

After the insertion of the terminals is complete, the TPA member 16 is moved from the initial or terminal insertion position to a final or terminal lock position, as shown in FIG. 7. As the member 16 is moved to the terminal lock position, the webs 133 are moved toward the openings 70 of the cavities 26. As this movement occurs, the webs 133 will engage the polarizing stubs 154 of any terminal 18 which has not been fully inserted. As the webs 133 are forced forward, the webs will force the terminals forward, thereby ensuring that all of the terminals will be properly positioned in the cavities.

The TPA member 16 is maintained in the final or terminal lock position by the cooperation of the latch bars 124 with the latch posts 46. As shown in FIG. 7, the latches 114 resiliently pivot to allow the latch bars 124 to move under the latch posts 46 as the member 16 is moved to the final position. As the member 16 reaches the final position, the latch bars emerge from the latch posts, thereby allowing the resiliency of the latches 114 to return the latches to an unstressed position, in which the latch bars cooperate with the latch posts to prevent the unwanted removal of the member 16 from the housing 12. It is worth noting that other types of conventional latching members can be used to maintain the TPA member in the final position on the housing.

With the TPA member 16 properly inserted onto the housing 12 and the terminals 18 retained therein, the assembly 10 is mounted to a panel or the like. The assembly 10 is moved into cooperation with edges of a panel opening 190 provided in panel 192 and secured thereto. As this occurs, lead-in surfaces 109 engage the edges of the opening 190, forcing the securing members 107 and spring arms 106 to resiliently deform. As the insertion of the assembly into the opening continues, the securing members 107 are moved beyond the edges, allowing the securing members and spring arms to resiliently return to their unstressed position. In this position shoulders 108 engage the panel 192 to prevent the unwanted removal of the assembly from the panel 192. Also in this position, the panel 192 engages the surfaces 111 of stop projections 110 to prevent the further advancement of the assembly relative to the panel. As this insertion occurs, polarizing projections 112 cooperate with polarizing openings 194 in the panel to ensure that the assembly 10 is properly positioned in the panel opening 190. Consequently, the assembly 10 is properly secured to the panel 192.

As the assembly 10 is moved into engagement with the panel 192, the anti-rattle projections cooperate with the sidewalls of the opening 190. As is best shown in FIG. 8 and 9, as the assembly 10 is moved into the panel opening 190, the projections 113 move from an unstressed position (FIG. 8) to a stressed position (FIG. 9). As was previously stated, in the unstressed position, projections have a compound inclined configuration, with the projections 113 being inclined from the fixed ends to the free ends, and the front end to the rear end, thereby positioning the front ends of the projections in an essentially coplanar configuration with the top and bottom surfaces.

As the front ends of the projections 113 are essentially coplanar with the top and bottom surfaces of the TPA member 16, and as the outside dimensions of the basic assembly (excluding latches and the like) are essentially smaller than the dimensions of the opening 190, the insertion of the assembly 10 into the opening 190 is easily accomplished. However, as the projections 113 are inclined from front to back, the continued insertion of the assembly 10 in the panel 192 causes the projections 113 to engage the sides of the opening 190. When the assembly is secured in the panel, as shown in FIG. 9, the anti-rattle projections are elastically deformed to a stressed position. As the projections are resilient, the projections attempt to return to their unstressed position, thereby causing a force to be exerted on the panel by the projections 113. As projections 113 are provided on all four corners of member 16, and as each projection is stressed, the combination of forces ensures that the assembly will be properly centered in the opening. The cooperation of the anti-rattle projections 113 with the sides of the openings 190 also insures that the assembly 10 will be maintained in position relative to the panel 192 even in harsh conditions, such as when the assembly and panel are exposed to vibration and the like. During vibration, the force exerted by the anti-rattle projections 113 on the panel 192 is sufficient to ensure that the assembly will not be moved relative to the panel.

The use of the anti-rattle projections ensures that the assembly will remain stable relative to the panel. This enables the latches 114 to be less complicated, as the latches are not required to compensate for the vibration of the assembly. The stability of the assembly relative to the panel also helps to provide a more reliable and stable electrical connection. Extreme vibration of the assembly can cause the mating terminals to be moved out of electrical connection over time, thereby resulting in a failure of the connector. The use of the anti-rattle projections reduces vibration and helps to prevent the unwanted unmating of the terminals, thereby resulting in a more effective electrical connection.

Changes in construction will occur to those skilled in the art and various apparently different modifications and embodiments may be made without departing form the scope of the invention. The matter set forth in the foregoing description and accompanying drawings is offered by way of illustration only. It is therefore intended that the foregoing description be regarded as illustrative rather than limiting.

I claim:

1. An electrical connector for insertion into an opening of a panel, the electrical connector having a housing with terminals positioned in terminal receiving cavities, a frame member positioned in latching engagement with the housing, the frame member having resilient fingers which are aligned with and extend into the terminal receiving cavities, the frame member being movable between a terminal insertion position and a terminal lock position, the electrical connector further comprising:

resilient projections extending from the frame member, the resilient projections have first ends which are essentially coplanar with respective surfaces of the frame, and second ends which are spaced from the respective surfaces of the frame, the resilient projections have a compound inclined configuration, whereby as the electrical connector is inserted into the opening of the panel, the resilient projections will be elastically deformed by sidewalls of the opening, thereby causing the resilient projections to exert a force on the sidewalls of the opening.

2. An electrical connector as recited in claim 1 wherein the resilient projections extend from top and bottom surfaces of the frame member.

3. An electrical connector as recited in claim 2 wherein the resilient projections are integrally molded with the top and bottom surfaces of the frame member.

4. An electrical connector as recited in claim 3 wherein the resilient projections have an inclined configuration between the first ends and the second ends, the second ends positioned outside the plane of the top and bottom surfaces of the frame, whereby as the electrical connector is initially inserted into the opening of the panel, the resilient projections will not engage the sidewall of the opening, and as the electrical connector is finally inserted into the openings, the resilient projections will engage the sidewalls of the opening.

5. An electrical connector as recited in claim 1 wherein the resilient projections are positioned on each corner of the frame member, thereby ensuring that the combination of forces applied by the resilient projections to the sidewall of the opening will cause the connector to be centered in the opening.

6. An electrical connector for insertion into an opening of a panel comprising:

resilient projections extending from the connector, the resilient projections have first ends which are essentially coplanar with respective surfaces of the connector, and second ends which are spaced from the respective surfaces of the connector, the resilient projections have a compound inclined configuration;

whereby as the electrical connector is inserted into the opening of the panel, the resilient projections will be elastically deformed by sidewalls of the opening, thereby causing the resilient projections to exert a force on the sidewalls of the opening.

7. An electrical connector as recited in claim 6 wherein the resilient projections have an inclined configuration between the first ends and the second ends, the second ends positioned outside the plane of the respective surfaces of the connector, whereby as the electrical connector is initially inserted into the opening of the panel, the resilient projections will not engage the sidewall of the opening, and as the electrical connector is finally inserted into the opening the resilient projections will engage the sidewalls of the opening.

8. An electrical connector as recited in claim 6 wherein the resilient projections are positioned on each corner of the connector, thereby ensuring that the combination of forces applied by the resilient projections to the sidewall of the opening will cause the connector to be centered in the opening.

* * * * *